US010736376B2

(12) United States Patent
Anderson

(10) Patent No.: US 10,736,376 B2
(45) Date of Patent: Aug. 11, 2020

(54) FOLDABLE FOOTWEAR DEVICE

(71) Applicant: Thelma Anderson, Grand Prairie, TX (US)

(72) Inventor: Thelma Anderson, Grand Prairie, TX (US)

( * ) Notice: Subject to any disclaimer, the term of this patent is extended or adjusted under 35 U.S.C. 154(b) by 98 days.

(21) Appl. No.: 16/153,145

(22) Filed: Oct. 5, 2018

(65) Prior Publication Data

US 2020/0107605 A1 Apr. 9, 2020

(51) Int. Cl.

| | |
|---|---|
| ***A43B 1/00*** | (2006.01) |
| ***A43B 3/24*** | (2006.01) |
| ***A43B 13/14*** | (2006.01) |
| ***A43B 3/12*** | (2006.01) |

(52) U.S. Cl.

CPC ..... *A43B 3/248* (2013.01); *A43B 3/128* (2013.01); *A43B 3/246* (2013.01); *A43B 13/141* (2013.01)

(58) Field of Classification Search

CPC ..... A43B 3/248; A43B 3/128; A43B 3/126; A43B 3/122

USPC ..... 36/26, 11.5, 102

See application file for complete search history.

(56) References Cited

U.S. PATENT DOCUMENTS

| | | | | |
|---|---|---|---|---|
| 7,448,148 | B2 | 11/2008 | Martinez et al. | |
| 7,694,435 | B1 | 4/2010 | Kiser et al. | |
| 8,510,975 | B2 | 8/2013 | Krikelis | |
| 8,763,275 | B2 * | 7/2014 | Shalom | A43B 3/246 36/102 |
| 9,089,184 | B1 | 7/2015 | Kiser et al. | |
| 2006/0174613 | A1 * | 8/2006 | Pritchard | F01B 17/04 60/370 |
| 2007/0204483 | A1 | 9/2007 | Kirsch et al. | |
| 2010/0018080 | A1 | 1/2010 | Smith | |
| 2010/0281713 | A1 | 11/2010 | Pantazes | |
| 2011/0016748 | A1 | 1/2011 | Soler | |

* cited by examiner

*Primary Examiner* — Timothy K Trieu

(74) *Attorney, Agent, or Firm* — Patentfile, LLC; Bradley C. Fach; Steven R. Kick

(57) ABSTRACT

A foldable footwear device may include a fore sole, having a fore upper surface and a fore lower surface, and an aft sole, having an aft upper surface and an aft lower surface. A hinge may pivotally couple the fore sole to the aft sole. The hinge may be configured to enable the fore sole and the aft sole to be moved between a planar position in which the fore upper surface and the aft upper surface may be substantially parallel and continuous with each other and a folded position in which the fore lower surface and aft lower surface may be contacting each other. A fore distal fastener may be coupled to the fore sole, and an aft distal fastener may be coupled to the aft sole. The fore distal fastener may removably engage with the aft distal fastener to secure the device in the folded position.

16 Claims, 7 Drawing Sheets

FOLDABLE FOOTWEAR DEVICE

FIELD OF THE INVENTION

This patent specification relates to the field of footwear devices. More specifically, this patent specification relates to a footwear device that is easily movable in and out of a compacted state for storage when not in use.

BACKGROUND

Having a readily accessible pair of auxiliary footwear, that is both comfortable to walk in and stylish, is a convenience that most people go without for many reasons. One of the most common reasons is that people frequently are unable to find a pair of auxiliary footwear that is both small enough so easily store while also being comfortable to wear should the need arise. For example, on days where women may choose to wear heels, it can be tiring to go on throughout the day as their feet tend to ache from long walks or being on their feet for hours. Bringing a pair of flat shoes to change into for relief can be an option; however, finding a place to store them, such as having to go back to their vehicle to retrieve them can be tedious and bothersome.

While some examples of footwear that is able to be stored in a compact state exist, they often suffer from one or more drawbacks. Some footwear is extremely flexible so as to be able to be rolled up into a compacted state. However, this type of footwear offers poor cushioning which can further aggravate one's feet. Other footwear may be configured to be folded in to a compact state, but this footwear frequently becomes unfolded on its own and can become aggravatingly entangled with other items it may be stored proximate to.

Therefore, a need exists for a novel footwear device that is easily movable in and out of a compacted state for storage when not in use. A further need exists for the novel footwear device to be both comfortable to walk in and stylish. There is also a need for the novel footwear device to not become unfolded on its own so as to become aggravatingly entangled with other items it may be stored proximate to.

BRIEF SUMMARY OF THE INVENTION

A foldable footwear device is provided which is easily movable in and out of a compacted state for storage when not in use. In some embodiments, the device may include a fore sole having a fore upper surface and a fore lower surface, and an aft sole having an aft upper surface and an aft lower surface. A foot securement article may be coupled to both the fore sole and the aft sole. A hinge may pivotally couple the fore sole to the aft sole. The hinge may be configured to enable the fore sole and the aft sole to be moved between a planar position in which the fore upper surface and the aft upper surface may be substantially parallel and continuous with each other and a folded position in which the fore lower surface and aft lower surface may be contacting each other. A fore distal fastener may be coupled to the fore sole, and an aft distal fastener may be coupled to the aft sole. The fore distal fastener may removably engage with the aft distal fastener to secure the device in the folded position.

In further embodiments, the device may include a male protrusion that is removably received in a female depression when the device is in the planar position.

In further embodiments, the device may include an aft hinge fastener and a fore hinge fastener, and the aft hinge fastener may removably engage with the fore hinge fastener to secure the device in the planar position.

In still further embodiments, the hinge may be movable between an extended position and a retracted position.

In yet further embodiments, the device may include a male protrusion that may be removably received in a female depression when the device is in the planar position, and the male protrusion may be removed from the female depression when the hinge is moved into the extended position.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
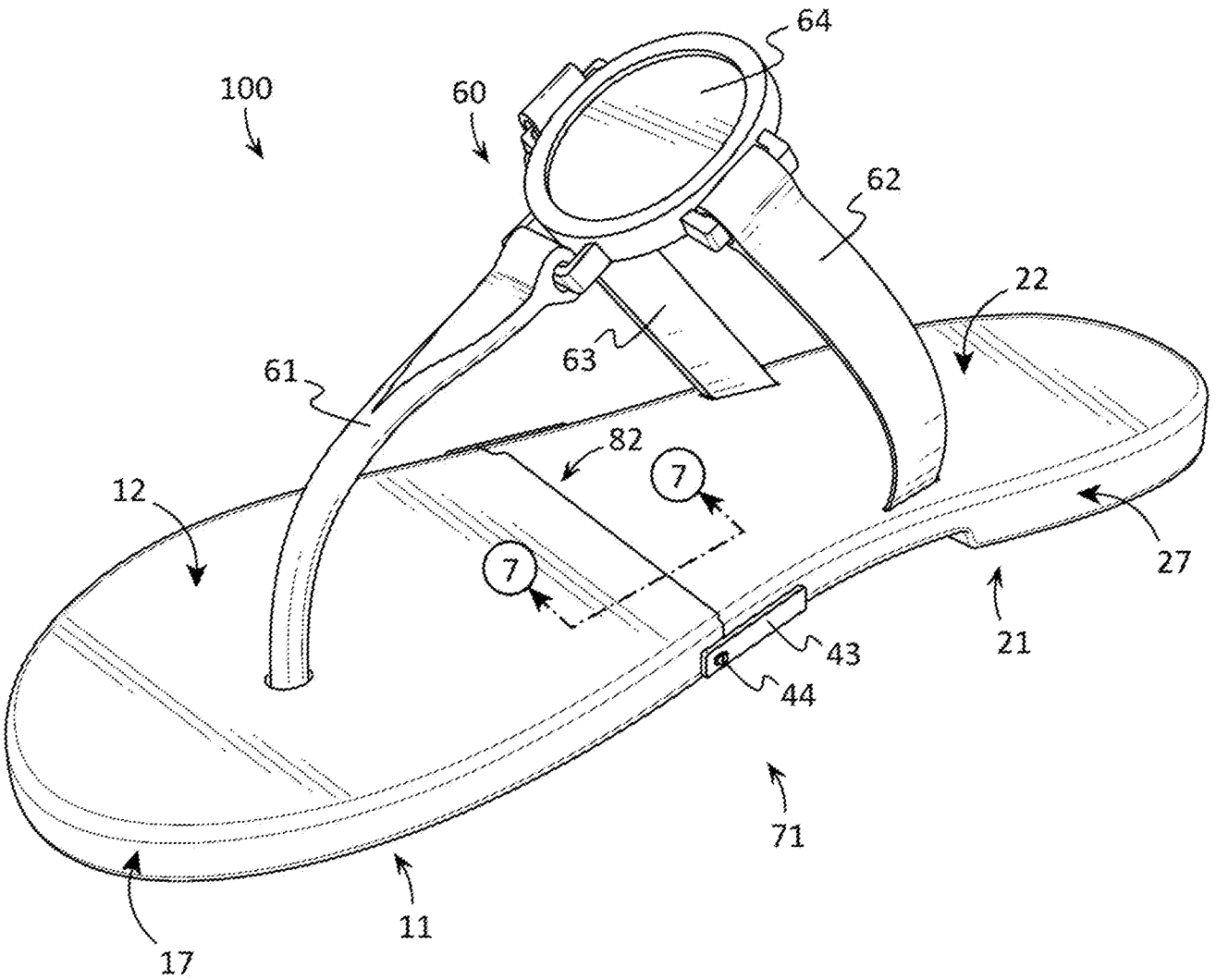
FIG. 1—FIG. 1 depicts a top perspective view of an example of a foldable footwear device in a planar position according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new foldable footwear device that is easily movable in and out of a compacted state for storage when not in use is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-4 illustrate examples of a foldable footwear device ("the device") 100 according to various embodiments. In some embodiments, the device 100 may comprise a fore sole 11 having a fore upper surface 12 and a fore lower surface 13, and an aft sole 21 having an aft upper surface 22 and an aft lower surface 23. A foot securement article 60 may be coupled to both the fore sole 11 and the aft sole 21. A hinge 31 may pivotally couple the fore sole 11 to the aft sole 21. The hinge 31 may be configured to enable the fore sole 11 and the aft sole 21 to be moved between a planar position 71 in which the fore upper surface 12 and the aft upper surface 22 may be substantially parallel and continuous with each other and a folded position 72 in which the fore lower surface 13 and aft lower surface 23 may be contacting each other. A fore distal fastener 14 may be coupled to the fore sole 11, and an aft distal fastener 24 may be coupled to the aft sole 21. The fore distal fastener 14 may removably engage with the aft distal fastener 24 to secure the device 100 in the folded position 72.

In some embodiments, the device 100 may comprise a foot securement article 60 which may be configured to secure and position the device 100 on the foot of a user. A user's foot may be placed on the fore 11 and aft 21 soles, and the foot securement article 60 may extend around the top and upper portions of the user's foot and optionally their ankle and/or legs. In some embodiments, a foot securement article 60 may be coupled to the aft sole 21 in at least two locations on the aft sole 21. For example, a foot securement article 60 may be configured as a foot thong having a toe strap 61 which may be positioned between the toe(s) of the foot and an inner strap 62 and outer strap 63 which may be positioned inside and outside portions of the foot, respectively. Optionally, the foot securement article 60 may comprise a coupler 64 which may be configured to couple one or more straps 61, 62, 63, together. A coupler 64 may configured in any shape and size. Preferably, a coupler 64 may be configured as a medallion, ring, or any other stylish and fashionable foot adornment optionally comprising a logo, picture, or other design.

While in some embodiments, a foot securement article 60 may be generally configured as a foot thong with relatively narrow straps 61, 62, 63, it should be understood that a foot securement article 60 may be configured in any shape and size. For example, one or more straps 61, 62, 63, may be configured a being relatively wider so as to substantially cover or surround portions of a user's foot as a shoe upper. Additionally, a foot securement article 60 may comprise any number of straps 61, 62, 63, which may be woven, intertwined, or otherwise coupled together to cover or surround all or portions of a user's foot.

In preferred embodiments, a foot securement article 60 may comprise a flexible material which may allow the foot securement article 60 to bend, flex, or otherwise be malleable in shape. A flexible material may include synthetic materials and fibers such as nylon webbing, polypropylene webbing, polyester webbing, neoprene foam rubber, polyester fabrics, rayon fabrics, and from natural materials and fibers such as cotton webbing, flax webbing, other fabrics, such as flax, coir, cotton, hemp, jute, leather, linen, ramie, wool, silk or any other type of natural or synthetic fibers or materials including combinations of materials. In further embodiments, a flexible material may comprise plastic chain or links, metal chain or links, wood or other plant material chain or links, rope, or any other material which may bend, flex, or otherwise be malleable in shape.

Generally, the device 100 may comprise a foot bed that may be formed by the fore 11 and aft 21 soles and which may be wearable on the foot of a user and held in place via the foot securement article 60. The fore upper surface 12 may be configured to receive approximately the front half of a foot while the aft upper surface 22 may be configured to receive approximately the back half of the foot when the device 100 is worn by a user. Additionally, the fore lower surface 13 and aft lower surface 23 may be configured to contact a ground surface when the device 100 is worn by a user so that the user's foot may be supported above the ground surface by the fore 11 and aft 21 soles. The fore upper surface 12 and fore lower surface 13 may be separated by a fore central surface 16 and a fore distal surface 17, while the aft upper surface 22 and aft lower surface 23 may be separated by an aft central surface 26 and an aft distal surface 27. Generally, the central surfaces 16, 26, may form the perimeter of their respective sole 11, 21, to which the hinge 31 may be coupled to or proximate to, while the distal surfaces 17, 27, may form the perimeter of their respective sole 11, 21, distal to the hinge 31.

The fore 11 and aft 21 soles may be configured in any shape and size. Preferably, the fore sole 11 may be configured with a generally wider or larger shape while the aft sole 21 may be configured with a generally narrower or smaller shape so that the fore 11 and aft 21 soles may be shaped to be slightly larger but similar in dimensions to the human foot pattern. It should be understood that the device 100 may be configured to be worn on the right and/or left foot and sized or scaled to accommodate the foot size or shoe size of any individual.

The fore 11 and aft 21 soles may comprise or may be formed with any suitable material commonly used in footwear. In some embodiments, fore 11 and/or aft 21 soles may comprise or may be formed with a flexible material such as natural and/or synthetic leather material, natural and/or synthetic fabric materials such as canvas, mesh fabric, etc., natural and/or synthetic rubber material such as latex rubber, silicone foam, silicone rubber, rubber foam, urethane foam, plastic foam, neoprene foam, latex foam rubber, polyurethane foam rubber, forms of the organic compound isoprene, Polyacrylate Rubber, Ethylene-acrylate Rubber, Polyester Urethane, flexible plastics, such as high-density polyethylene (HDPE), polyvinyl chloride (PVC), polypropylene (PP), Polystyrene (PS), Polycarbonate (PC), low density polyethylene (LDPE), or any other flexible material including combinations of materials. In further embodiments, fore 11 and/or aft 21 soles may comprise or may be formed with a substantially rigid material such as steel alloys, aluminum, aluminum alloys, copper alloys, other types of metal or metal alloys, ceramics such as alumina, porcelain, and boron carbide, earthenware, natural stone, synthetic stone, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials.

As perhaps best shown by FIGS. 1-6, the device 100 may be movable between a planar position 71 in which the fore upper surface 12 and the aft upper surface 22 may be substantially parallel and continuous with each other and a folded position 72 in which the fore lower surface 13 and aft lower surface 23 are contacting each other. While in the planar position 71 the device 100 may be suitable for being worn on the foot of a user and while in the folded position 72 the device 100 may occupy a compacted state for suitable for storage such as when the device 100 is not in use.

The device 100 may comprise one or more hinges 31 which may pivotally couple the fore sole 11 to the aft sole 21 so that the hinge 31 may enable the fore sole 11 and the aft sole 21 to be moved between the planar position 71 and the folded position 72. In some embodiments, a hinge 31 may comprise a piano hinge, a butt hinge, barrel hinge, butt/Mortise hinge, case hinge, flag hinge, strap hinge, H hinge, HL hinge, piano hinge, butterfly hinge, flush hinge, concealed hinge, continuous hinge, T-hinge, double-acting hinge, Soss hinge, counterflap hinge, flush hinge, coach hinge, rising butt hinge, double action spring hinge, tee hinge, friction hinge, security hinge, cranked hinge or stormproof hinge, lift-off hinge, self closing or self positioning hinge, flexible material hinge, living hinge, or any other type or style of hinge suitable for pivotally joining the fore sole 11 to the aft sole 21.

Figure 2:
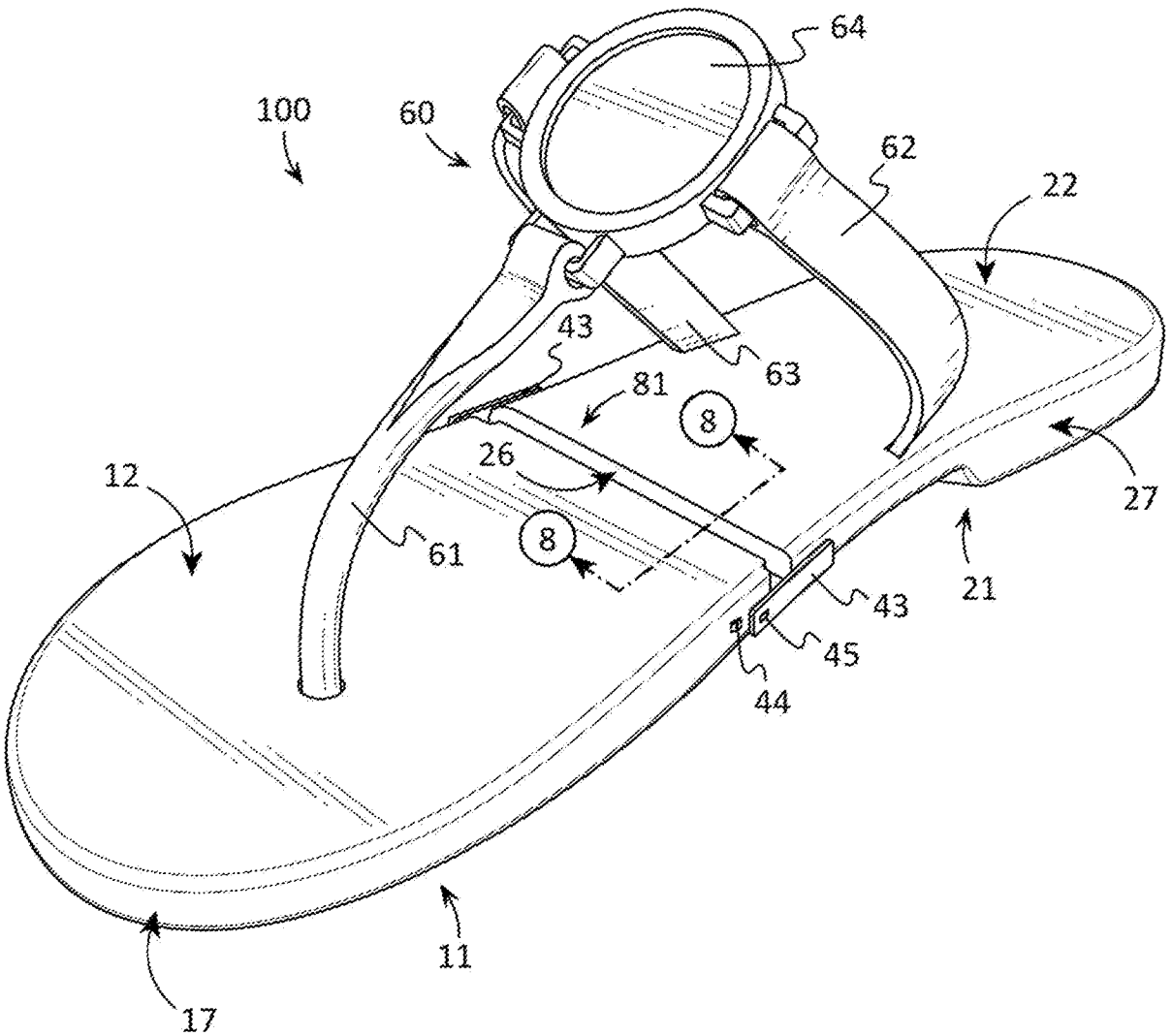
FIG. 2—FIG. 2 illustrates a top perspective view of an example of a foldable footwear device having a hinge in an extended position according to various embodiments described herein.
Figure 3:
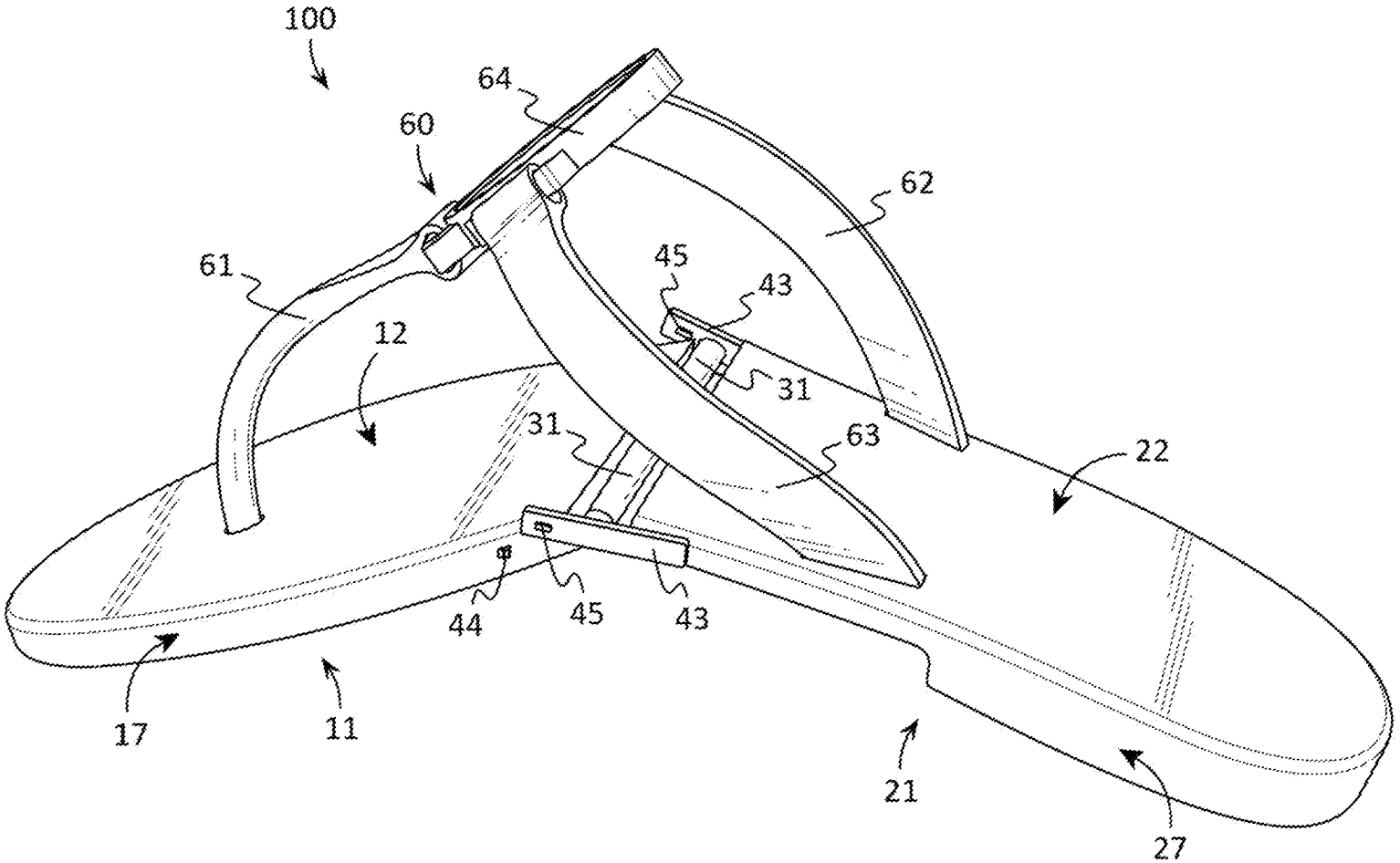
FIG. 3—FIG. 3 shows a perspective view of an example of a foldable footwear device being moved between a planar position and a folded position according to various embodiments described herein.
Figure 4:
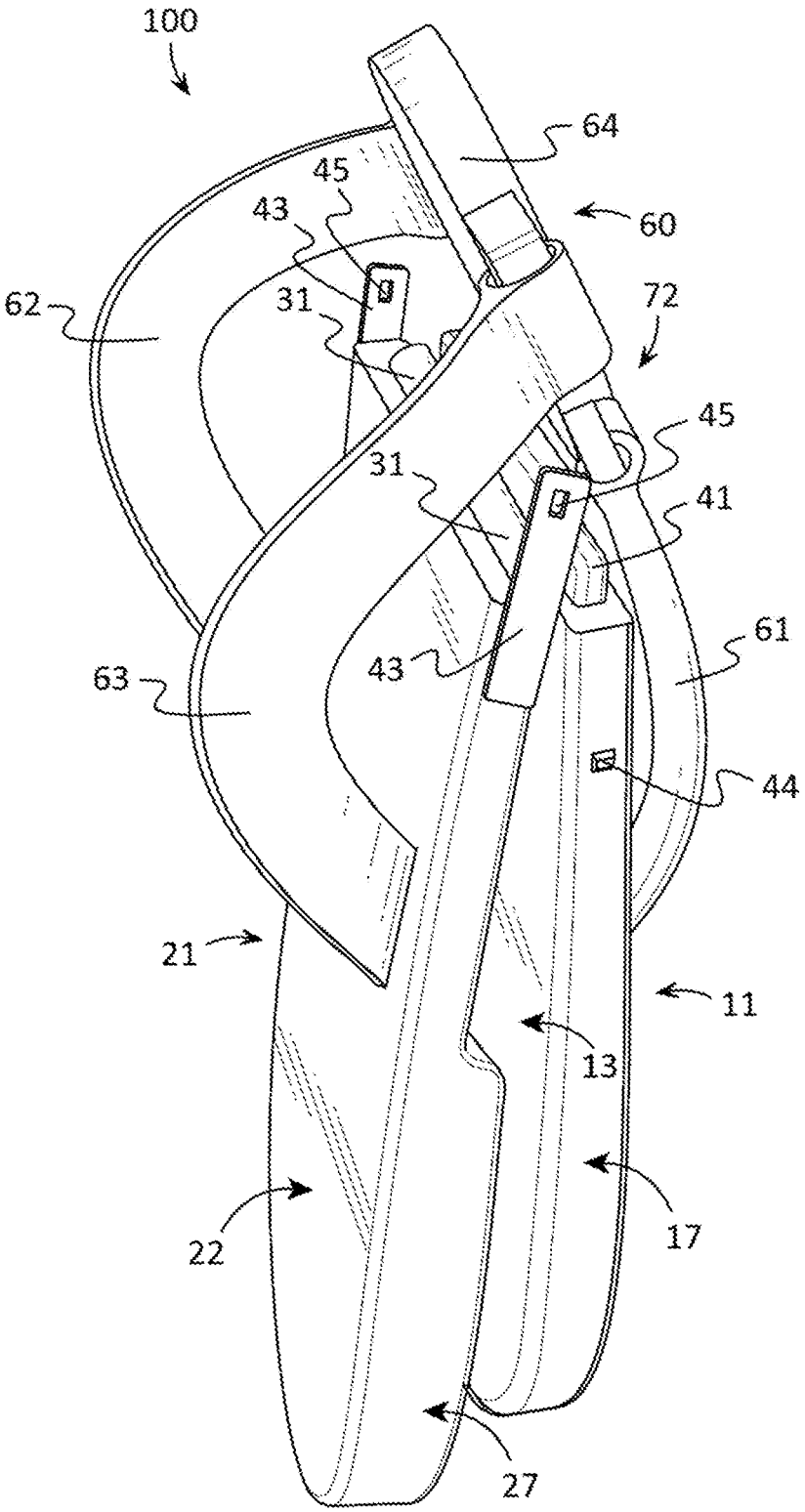
FIG. 4—FIG. 4 depicts a perspective view of an example of a foldable footwear device in a folded position according to various embodiments described herein.
Figure 7:
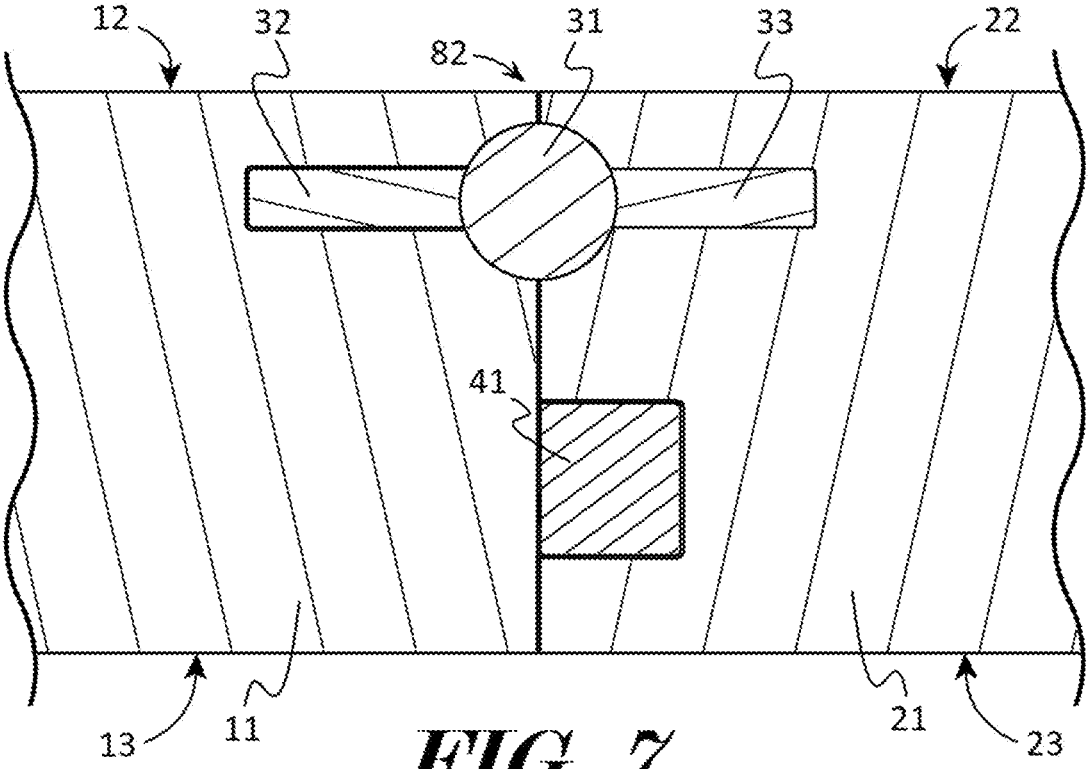
FIG. 7—FIG. 7 depicts a sectional, through line 7-7 shown in FIG. 1, elevation view of an example of a hinge, of a foldable footwear device, in a retracted position according to various embodiments described herein.
Figure 8:
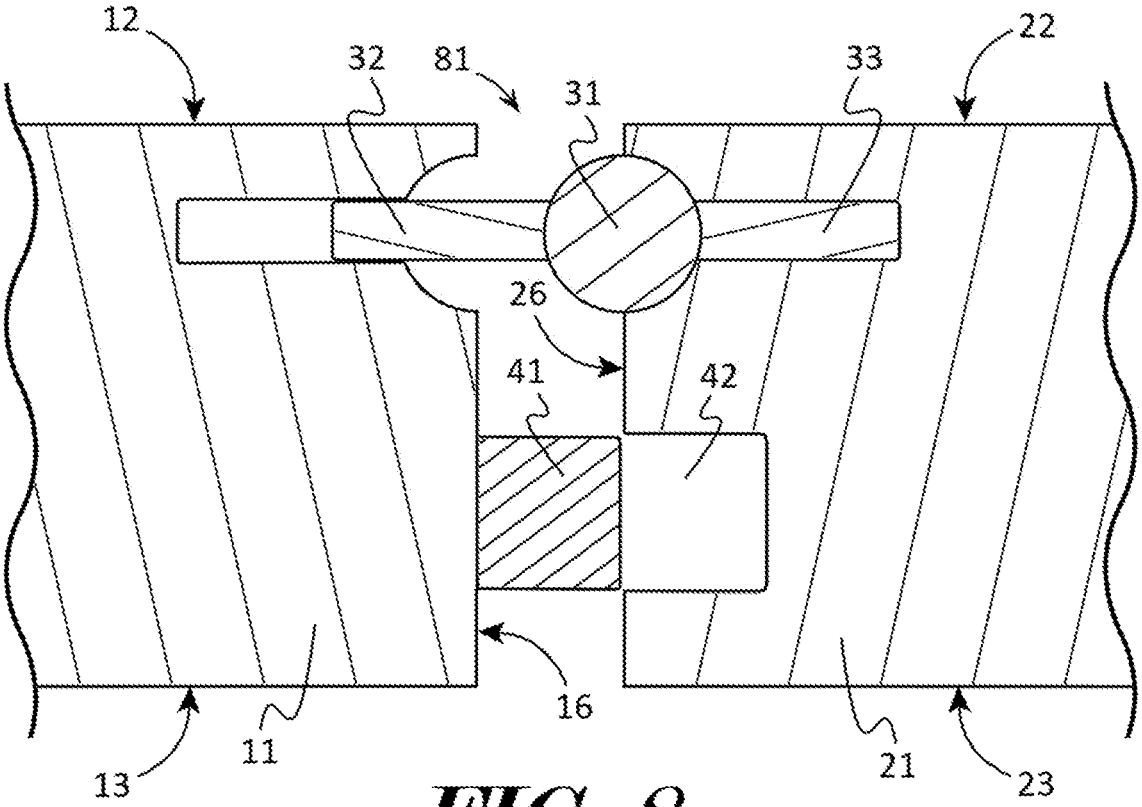
FIG. 8—FIG. 8 illustrates a sectional, through line 8-8 shown in FIG. 2, elevation view of an example of a hinge, of a foldable footwear device, in an extended position according to various embodiments described herein.

In preferred embodiments, a hinge 31 may be movable between an extended position 81 and a retracted position 82 so that the portions of the fore sole 11 and the aft sole 21 that are closest to each other may be moved together, so as to contact each other as best shown in FIGS. 1 and 7, and moved apart, do as to not contact each other as best shown in FIGS. 2 and 8. By moving the hinge 31 into and out of the retracted position 82, the central surfaces 16, 26, may be moved into and out of contact or proximity with each other, respectively. In some embodiments, a hinge 31 may be configured to be extended and retracted by having a hinge plate 32, 33, which may be movably coupled to a sole 11, 21. For example, a hinge 31 may comprise a fore hinge plate 32 which may form the portion of the hinge 31 that may be coupled to the fore sole 11 and an aft hinge plate 33 which may form the portion of the hinge 31 that may be coupled to the aft sole 21. At least one hinge plate 32, 33, such as the fore hinge plate 32, may be movably coupled to its respective sole 11, 21. This movably coupling may enable the fore sole 11 and the aft sole 21 to be moved into and between the extended position 81 and a retracted position 82. While in some embodiments, a hinge plate 32, 33, may be movably coupled to its respective sole 11, 21, in other embodiments, a hinge 31 may be configured as a floating hinge or any other type of hinge which may allow the tow objects that it is pivotally coupling together to also be extended away from and retracted towards each other.

Figure 5:
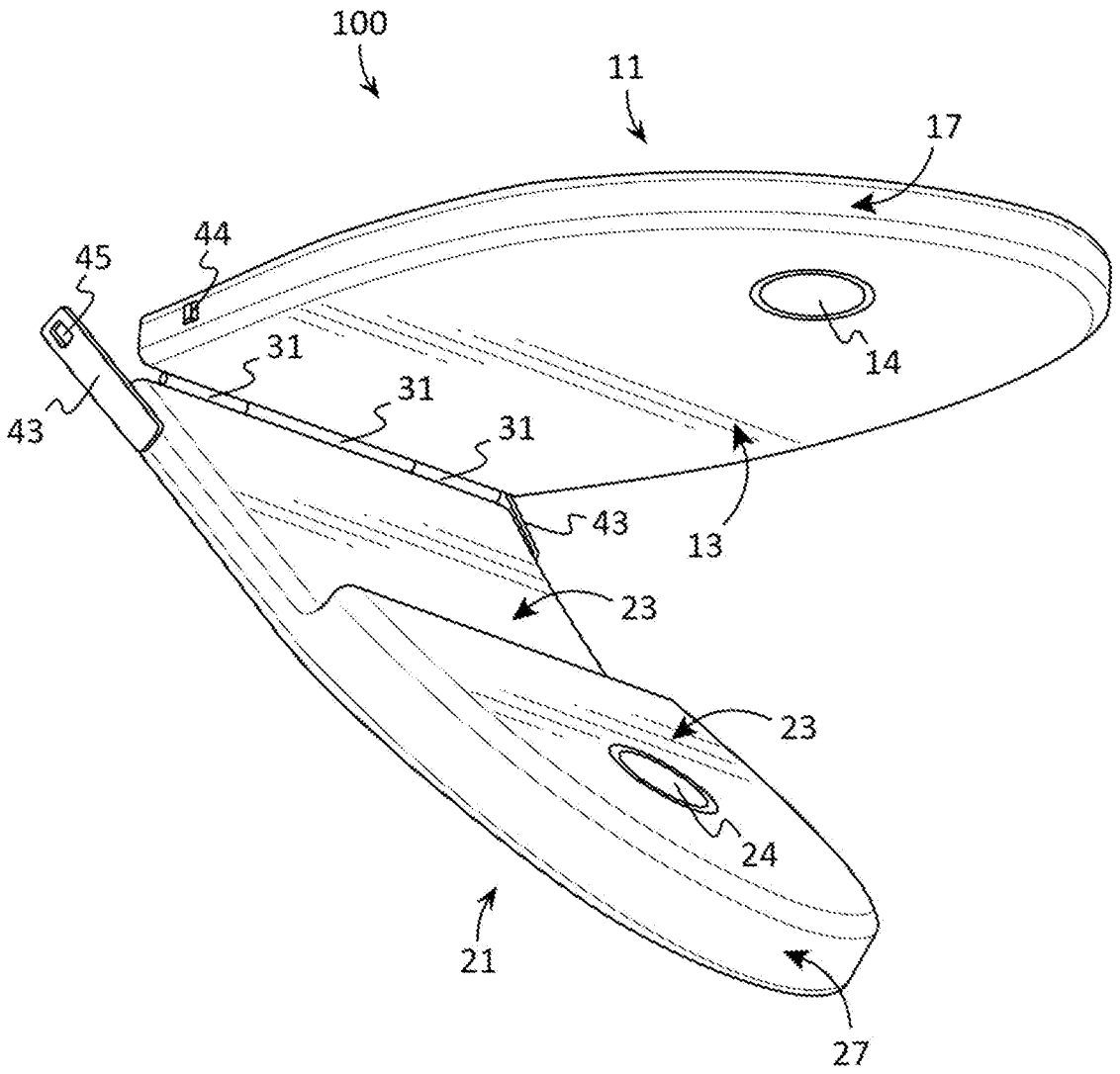
FIG. 5—FIG. 5 illustrates a perspective view of another example of an aft sole and a fore sole of a foldable footwear device being moved between a planar position and a folded position according to various embodiments described herein.

In some embodiments and as shown in FIG. 5, the device 100 may comprise a fore distal fastener 14 which may be coupled to the fore sole 11 and an aft distal fastener 24 may be coupled to the aft sole 21. The fore distal fastener 14 may removably engage with the aft distal fastener 24 to secure the device 100 in the folded position 72. Distal fasteners 14, 24, may be positioned anywhere on their respective sole 11, 21. Preferably, distal fasteners 14, 24, may be positioned on their respective sole 11, 21, so that they are brought into contact or proximate with each other when the device 100 is moved into the folded position 72. Any suitable fastener or fastening method may be used to removably engage distal fasteners 14, 24, together. For example, distal fasteners 14, 24, may comprise snap fit fasteners, press fit fasteners, hook and loop type fasteners, or any other type of fasteners.

In preferred embodiments, a fore distal fastener 14 and aft distal fastener 24 may be magnetically engaged together. In some embodiments, a fore distal fastener 14 and/or an aft distal fastener 24 may include a magnetic material that may be or may comprise a high-coercivity ferromagnetic compound type of magnetic material such as ferric oxide mixed with a plastic binder. In further embodiments, a fore distal fastener 14 and/or an aft distal fastener 24 may include a magnetic material such as ferrite, manganese-zinc ferrite, nickel-zinc ferrite, strontium ferrite, cobalt ferrite, barium ferrite, magnetic alloys such as alnico, comol, Hypernom® magnetic alloy, manganese-zinc ferrite, iron-silicon magnet alloys, nickel-zinc ferrite, ferritic stainless steel alloys, strontium ferrite, barium ferrite, alnico, iron-silicon magnet alloy, Chromindur® (Chromium-Cobalt-Iron) alloys, Silmanal (Silver-Manganese-Aluminium) alloys, Platinax II (platinum-cobalt) alloy, Bismanol (manganese bismuthide) alloy, cobalt-platinum alloys, chromium-manganese antimonide alloy, vectolite (cobalt ferrite), magnadur (sintered barium ferrite), lodex (oxide-coated iron-cobalt particles), awaruite ($Ni_2Fe$ to $Ni_3Fe$ nickel-iron alloy), wairauite, rare earth magnets such as samarium-cobalt, cesium-cobalt, neodymium-iron-boron, other neodymium magnet materials, metallic oxides such as magnetite, ulvospinel, hematite, ilmenite, maghemite, jacobsite, iron sulfides such as pyrrhotite, greigite, troilite, metallic oxyhydroxides such as goethite, lepidocrocite, feroxyhyte, ferrimagnetic materials such as magnetite, pyrrhotite, cubic ferrites, hexagonal ferrites, ferromagnetic materials including metals such as iron, nickel, cobalt, metal alloys containing iron, nickel, and/or cobalt, soft magnetic materials, hard magnetic materials, or any other suitable magnetic material, that is capable of magnetically adhering to another magnetic material through the principle of magnetism.

Figure 6:
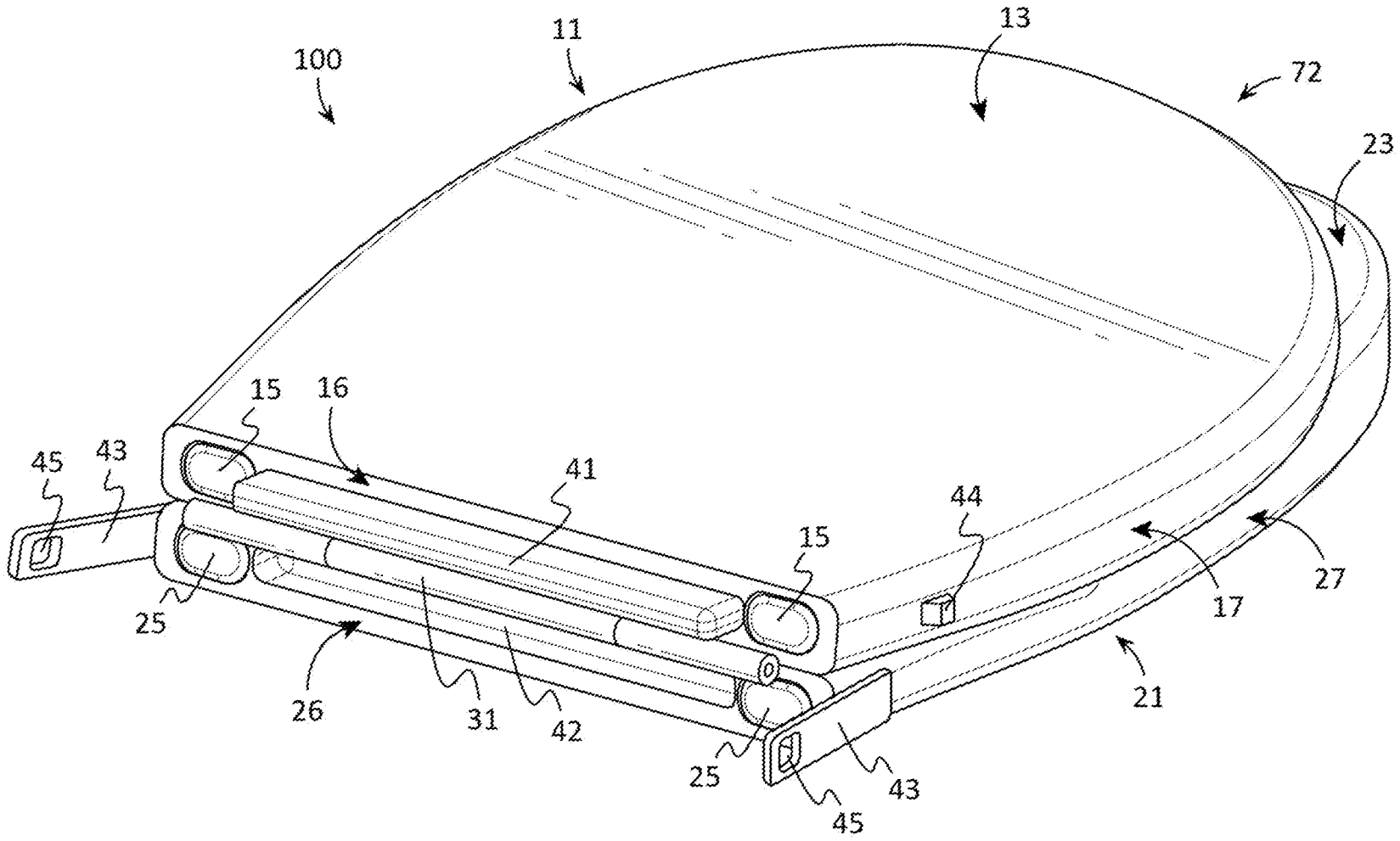
FIG. 6—FIG. 6 shows a perspective view of another example of an aft sole and a fore sole of a foldable footwear device in a folded position according to various embodiments described herein.

In some embodiments, the device 100 may comprise a male protrusion 41 that may be removably received in a female depression 42 when the device 100 is in the planar position 71. In further embodiments, when a male protrusion 41 is received or engaged in a female depression 42, the engagement may maintain the device 100 in the planar position 71. In still further embodiments, when a male protrusion 41 is received or engaged in a female depression 42, the engagement may prevent the device 100 from being moved out of the planar position 71. A male protrusion 41 and female depression 42 may be configured in any shape and size. In some embodiments, a male protrusion 41 and female depression 42 may each be configured with a generally elongated shape that may extend approximately from one side of the soles 11, 21, to the other as shown in FIG. 6. In other embodiments, the device 100 may comprise two, three, four, five, six, or more, such as a plurality of male protrusions 41 and/or female depressions 42 which may be engaged together in a one-to-one ratio or any other ratio.

In preferred embodiments, a male protrusion 41 and female depression 42 may be configured with complementary or mirrored shapes so that the male protrusion 41 may fit the female depression 42 with close tolerances so that the male protrusion 41 may be frictionally received or secured in the female depression 42. In further preferred embodiments, the device 100 may comprise a male protrusion 41 that may be removably received in a female depression 42 when the device 100 is in the planar position 72, and the male protrusion 41 may be removed from the female depression 42 when the hinge 31 is moved out of the retracted position 82 and/or moved into the extended position 81.

In some embodiments, the device 100 may comprise a fore hinge fastener 15 and an aft hinge fastener 25, and the fore hinge fastener 15 may removably engage with the aft hinge fastener 25 to secure the device 100 in the planar position 71. Fore hinge fasteners 15 and aft hinge fasteners 25 may be positioned anywhere on their respective sole so that they may be aligned with each other when the device 100 is in the planar position 71 so as to enable a fore hinge fasteners 15 and an aft hinge fastener 25 to be brought into contact or proximate with each other when the device 100 is moved into the planar position 71. In preferred embodiments, the device 100 may comprise two fore hinge fasteners 15 which may be coupled to the fore sole 11 on opposite sides of the hinge(s) 31 and, likewise, two aft hinge fasteners 25 which may be coupled to the aft sole 21 on opposite sides of the hinge(s) 31. Any suitable fastener or fastening method may be used to removably engage distal fasteners 14, 24, together. For example, distal fasteners 14, 24, may comprise snap fit fasteners, press fit fasteners, hook and loop type fasteners, or any other type of fasteners. In preferred embodiments, a fore hinge fastener 15 and aft hinge fastener 25 may be magnetically engaged together. In some embodiments, a fore hinge fastener 15 and/or an aft hinge fastener 25 may include a magnetic material, such as which may be used for a fore distal fastener 14 and/or an aft distal fastener 24.

In some embodiments, the device 100 may comprise a latch 43 and a pin 44 that may be configured to be removably engaged together, and the engagement between the latch 43 and pin 44 may prevent the device 100 from being moved out of the planar position 71. In some embodiments, a pin 44 may comprise a protrusion that may extend up and away from a distal surface 17, 27, that may be received in a complementarily shaped latch aperture 45 of a latch 43. In further embodiments, a latch 43 may be movably coupled to a distal surface 17, 27, to enable to latch 43 to be moved so that the latch aperture 45 may be moved over, onto, and/or off of a pin 44. A pin 44 and latch aperture 45 may be configured in any size and shape so that the pin 44 and latch aperture 45 may be mated together or otherwise removably engaged together. In preferred embodiments, the device 100 may comprise two latches 43 and two pins 44 with a latch 43 and pin 44 positioned on opposing portions of the distal surfaces 17, 27, that are proximate to the central surfaces 16, 26. In this manner, one latch 43 and one pin 44 may be positioned on the right side of the soles 11, 21, and the other latch 43 and pin 44 may be positioned on the left side of the soles 11, 21.

While some exemplary shapes and sizes have been provided for elements of the device 100, it should be understood to one of ordinary skill in the art that the soles 11, 21, foot securement article 60, male protrusion 41, female depression 42, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A foldable footwear device, the device comprising:

(a) a fore sole having a fore upper surface and a fore lower surface;

(b) an aft sole having an aft upper surface and an aft lower surface;

(c) a foot securement article coupled to both the fore sole and the aft sole;

(d) a hinge pivotally coupling the fore sole to the aft sole, wherein the hinge is configured to enable the fore sole and the aft sole to be moved between a planar position in which the fore upper surface and the aft upper surface are substantially parallel and continuous with each other and a folded position in which the fore lower surface and aft lower surface are contacting each other;

(e) a fore distal fastener coupled to the fore sole;

(f) an aft distal fastener coupled to the aft sole, wherein the fore distal fastener removably engages with the aft distal fastener to secure the device in the folded position;

(g) an aft hinge fastener and a fore hinge fastener, wherein the aft hinge fastener removably engages with the fore hinge fastener to secure the device in the planar position; and wherein the aft hinge fastener and fore hinge fastener are magnetically engaged together.

2. The device of claim 1, wherein the foot securement article is coupled to the aft sole in at least two locations on the aft sole.

3. The device of claim 1, wherein the foot securement article comprises a flexible material.

4. The device of claim 1, wherein the fore distal fastener and aft distal fastener are magnetically engaged together.

5. The device of claim 1, further comprising a male protrusion that is removably received in a female depression when the device is in the planar position.

6. The device of claim 5, wherein the male protrusion is frictionally received in the female depression.

7. The device of claim 1, further comprising a latch and a pin that are configured to be removably engaged together, wherein engagement between the latch and pin prevents the device from being moved out of the planar position.

8. The device of claim 1, wherein the hinge is movable between an extended position and a retracted position.

9. The device of claim 8, further comprising a male protrusion that is removably received in a female depression when the device is in the planar position, wherein the male protrusion is removed from the female depression when the hinge is moved into the extended position.

10. A foldable footwear device, the device comprising:

(a) a fore sole having a fore upper surface and a fore lower surface;

(b) an aft sole having an aft upper surface and an aft lower surface;

(c) a foot securement article coupled to both the fore sole and the aft sole;

(d) a hinge pivotally coupling the fore sole to the aft sole, wherein the hinge is configured to enable the fore sole and the aft sole to be moved between a planar position in which the fore upper surface and the aft upper surface are substantially parallel and continuous with each other and a folded position in which the fore lower surface and aft lower surface are contacting each other, and wherein the hinge is movable between an extended position and a retracted position;

(e) a fore distal fastener coupled to the fore sole;

(f) an aft distal fastener coupled to the aft sole, wherein the fore distal fastener removably engages with the aft distal fastener to secure the device in the folded position;

(g) a male protrusion that is removably received in a female depression when the device is in the planar position, wherein the male protrusion is removed from the female depression when the hinge is moved into the extended position;

(h) a pin positioned on and extending away from a first distal surface of the foldable footwear device; and (i) a latch moveably coupled to a second distal surface of the foldable footwear device, the latch comprising a latch aperture configured to mate with the pin to prevent the device from being moved out of the planar postion.

11. The device of claim 10, wherein the foot securement article is coupled to the aft sole in at least two locations on the aft sole.

12. The device of claim 10, wherein the foot securement article comprises a flexible material.

13. The device of claim 10, wherein the fore distal fastener and aft distal fastener are magnetically engaged together.

14. The device of claim 10, wherein the male protrusion is frictionally received in the female depression.

15. The device of claim 10, further comprising an aft hinge fastener and a fore hinge fastener, wherein the aft hinge fastener removably engages with the fore hinge fastener to secure the device in the planar position.

16. The device of claim 15, wherein the aft hinge fastener and fore hinge fastener are magnetically engaged together.

* * * * *